US009242259B2

(12) United States Patent
Jeronimus

(10) Patent No.: US 9,242,259 B2
(45) Date of Patent: Jan. 26, 2016

(54) EXTENDABLE SHOWER HEAD APPARATUS

(71) Applicant: Brian Jeronimus, Pinellas Park, FL (US)

(72) Inventor: Brian Jeronimus, Pinellas Park, FL (US)

( * ) Notice: Subject to any disclaimer, the term of this patent is extended or adjusted under 35 U.S.C. 154(b) by 566 days.

(21) Appl. No.: 13/744,338

(22) Filed: Jan. 17, 2013

(65) Prior Publication Data

US 2014/0197250 A1 Jul. 17, 2014

(51) Int. Cl.

| | |
|---|---|
| ***A62C 5/02*** | (2006.01) |
| ***B05B 7/26*** | (2006.01) |
| ***B05B 15/06*** | (2006.01) |
| ***B05B 3/00*** | (2006.01) |
| ***B05B 1/20*** | (2006.01) |
| ***A62C 13/62*** | (2006.01) |
| ***F23D 11/10*** | (2006.01) |
| ***B05B 1/00*** | (2006.01) |
| ***B05B 7/04*** | (2006.01) |
| ***E03C 1/046*** | (2006.01) |
| ***E03C 1/06*** | (2006.01) |
| *E03C 1/04* | (2006.01) |

(52) U.S. Cl.

CPC ..... *B05B 7/0408* (2013.01); *B05B 15/068* (2013.01); *E03C 1/046* (2013.01); *E03C 1/06* (2013.01); *E03C 2001/0415* (2013.01)

(58) Field of Classification Search

CPC ..... B05B 7/0408; B05B 15/068; E03C 1/06; E03C 1/046; E03C 2001/0415

USPC ..... 239/310, 315, 532, 282, 283, 380, 328, 239/318, 226, 266, 267, 209, 304, 600, 273, 239/211, 281, 423, 418, 195, 556, 566, 567, 239/589, 269, 444

See application file for complete search history.

(56) References Cited

U.S. PATENT DOCUMENTS

| | | | | | |
|---|---|---|---|---|---|
| 2,100,186 | A | * | 11/1937 | Hagopian | A47K 3/28 239/283 |
| 2,540,159 | A | * | 2/1951 | Antrim | A61H 9/00 4/598 |
| 2,948,479 | A | * | 8/1960 | Graceman | B60S 3/044 134/102.1 |
| 2,949,109 | A | * | 8/1960 | Koolnis | A61H 9/00 239/416.1 |
| 3,822,826 | A | * | 7/1974 | Wilson | E03C 1/06 239/267 |
| 3,913,839 | A | * | 10/1975 | Wilson | E03C 1/06 239/209 |
| 3,971,074 | A | * | 7/1976 | Yxfeldt | A47K 3/287 4/570 |
| 4,257,559 | A | * | 3/1981 | Noren | A47L 15/16 239/283 |
| 4,456,177 | A | * | 6/1984 | Johnson | B05B 15/061 239/209 |

(Continued)

*Primary Examiner* — Len Tran
*Assistant Examiner* — Steven M Cernoch

(57) ABSTRACT

An extendable shower head apparatus that includes a hollow support rod, the hollow support rod provides support to the extendable shower head apparatus, a connection piece that is movably connected to the hollow support rod and a shower head that includes a hollow stem. The apparatus also includes a plurality of wheel bearings that roll along the hollow support rod, a first hose extended through the wheel bearings and provides the water to the shower head, a tension pulley that supports movement of the first hose, a two hose connector attached to the second end of the first hose and a pipe that provides the water to the two hose connector used by a user, the pipe is connected to the two hose connector and the two hose connector connects the pipe to the second end of the first hose.

20 Claims, 1 Drawing Sheet

(56) References Cited

U.S. PATENT DOCUMENTS 4,545,083 A * 10/1985 Searson ..... E03C 1/06 239/556
4,998,693 A * 3/1991 Wiebe ..... B60S 3/04 239/195
5,035,010 A * 7/1991 Sakamoto ..... E03C 1/063 239/752
5,065,942 A * 11/1991 Shannon ..... B05B 7/0876 239/282
5,158,614 A * 10/1992 Takeuchi ..... B05B 13/041 118/323
5,564,139 A * 10/1996 Shorr ..... E03C 1/06 4/601
5,692,252 A * 12/1997 Zwezdaryk ..... E03C 1/0408 4/601
5,799,346 A * 9/1998 Tiernan ..... E03C 1/06 211/105.6
6,079,060 A * 6/2000 Walker ..... B05B 1/14 4/601
6,237,860 B1 * 5/2001 Ducey ..... F24F 5/0007 239/211
6,415,461 B1 * 7/2002 Singer ..... A47K 3/28 239/273
6,550,080 B1 * 4/2003 Grewal ..... A47K 3/281 4/601
6,991,184 B2 * 1/2006 Romaine ..... E03C 1/046 239/282
7,155,758 B1 * 1/2007 Berke ..... E03C 1/046 239/282
7,905,429 B2 * 3/2011 Somerfield ..... E03C 1/046 137/101.11
2002/0040941 A1 * 4/2002 Wiemer ..... A47L 15/4217 239/226
2006/0214025 A1 * 9/2006 Kim ..... B05B 9/04 239/310
2007/0209108 A1 * 9/2007 Shorr ..... E03C 1/066 4/601
2012/0286070 A1 * 11/2012 Lev ..... E03C 1/063 239/380

* cited by examiner

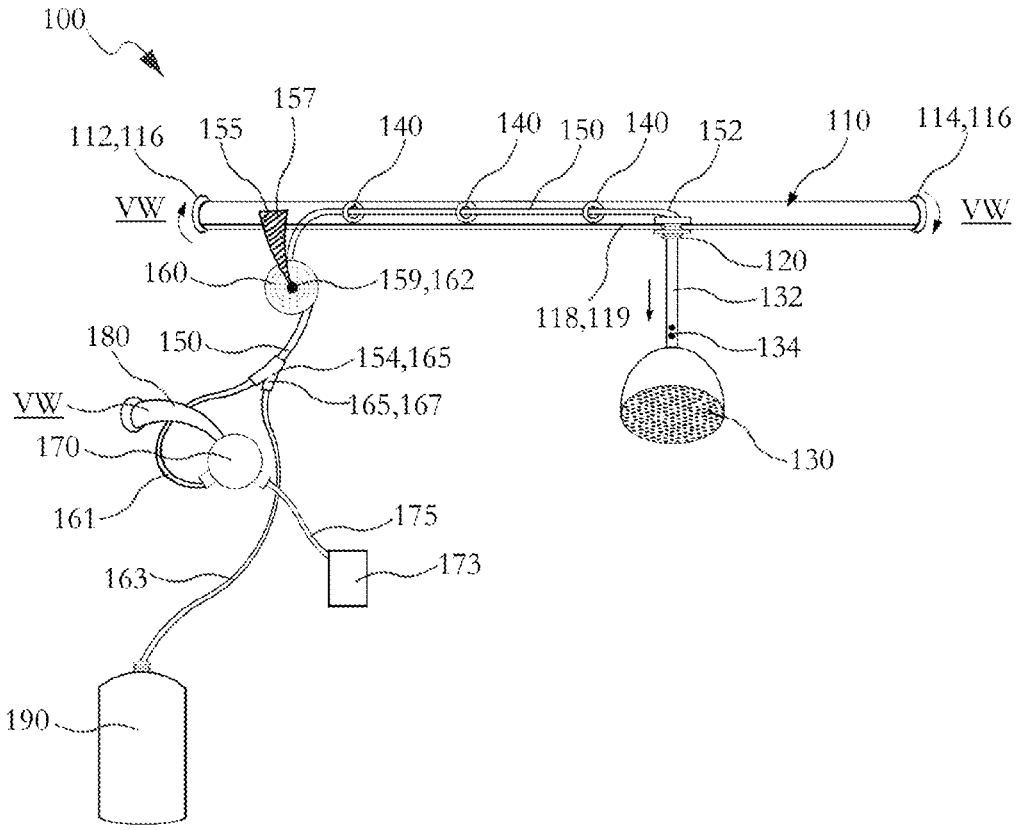
100
157
112,116
155
140
140
150
140
152
110
114,116
VW
VW
160
159,162
120
118,119
132
134
180
150
154,165
VW
165,167
170
130
161
175
173
163
190

EXTENDABLE SHOWER HEAD APPARATUS

TECHNICAL FIELD & BACKGROUND

Currently there are limited options for an adaptable shower appliance that permits freedom of movement while being utilized. Most popular current water mount accessories tend to have restricted piping that requires a user to stay in a fixed location while utilizing the adaptable shower appliance.

The present invention generally relates to a shower head apparatus. More specifically, the invention is an extendable shower head apparatus.

It is an object of the invention to provide an extendable shower head apparatus that permits a relatively greater freedom of movement than a traditional shower head.

It is an object of the invention to provide an extendable shower head apparatus that is made of relatively inexpensive materials to produce the extendable shower head apparatus at a relatively low price.

It is an object of the invention to provide an extendable shower head apparatus that is height adjustable to accommodate an adult as well as a child.

What is needed is an extendable shower head apparatus that permits a relatively greater freedom of movement than a traditional shower head that is made of relatively inexpensive materials to produce the extendable shower head apparatus at a relatively low price that is height adjustable to accommodate an adult as well as a child.

BRIEF DESCRIPTION OF THE DRAWINGS

The present invention will be described by way of exemplary embodiments, but not limitations, illustrated in the accompanying drawings in which like references denote similar elements, and in which:

FIG. 1 illustrates a side view of an extendable shower head apparatus, according to an embodiment of the present invention.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is utilized repeatedly. The phrase generally does not refer to the same embodiment, however, it may. The terms "comprising", "having" and "including" are synonymous, unless the context dictates otherwise.

FIG. 1 illustrates a side view of an extendable shower head apparatus 100, according to an embodiment of the present invention.

The extendable shower head apparatus 100 includes a hollow support rod 110, a connection piece 120, a shower head 130, a plurality of wheel bearings 140, a first hose 150, a support rod holder 155, a tension pulley 160, a two way connector 165, a two hose connector 170, a connector to a hand-held device 175, a pipe 180 and an electric pump dispenser 190. The hollow support rod 110 has a first end 112 and a second end 114 and provides support to the extendable shower head apparatus 100. The first end 112 and the second end 114 of the hollow support rod 110 each have a spring-loaded rubber end 116 that applies pressure on a contact surface such as a vertical wall VW or other suitable contact surface to hold-up the extendable shower head apparatus 100. The hollow support rod 110 is made of polyvinyl chloride or PVC but can be made of any suitable material. The connection piece 120 is movably connected to the hollow support rod 110 and moves along the hollow support rod 110. The shower head 130 includes a hollow stem 132 that is connected to the connection piece 120 that allows water to flow to the shower head 130. The shower head 130 is activated and shut-off by an on and off switch 134. The shower head 130 moves along the hollow support rod 110 that allows a user to move along the hollow support rod 110 providing the user with a relatively greater freedom of movement than a traditional shower head (not shown). The hollow support rod 110 includes a horizontal groove 118 disposed along a bottom portion 119 of the hollow support rod 110 to enable the shower head 130 and the connection piece 120 to move along the hollow support rod 110. The shower head 130 can also be extended outward from the hollow support rod 110. The shower head 130 can be extended outward by disconnecting the connection piece 120 from the hollow support rod 110 and pulling outward. The shower head 130 can be any suitable shower head type at any suitable water pressure with any suitable number of apertures to disperse water. The wheel bearings 140 roll along the hollow support rod 110 and facilitate the shower head 130 moving along the hollow support rod 110. The first hose 150 has a first end 152 and a second end 154 and is extended through the wheel bearings 140 and provides water to the shower head 130. The first end 152 of the first hose 150 is attached to the shower head stem 132 leading to the shower head 130. The support rod holder 155 has a first end 157 and a second end 159 and supports the hollow support rod 110. The first end 157 of the support rod holder 155 is attached to the support rod holder 155 and the second end 159 of the support rod holder 155 is attached to the tension pulley 160 with a rivet 162 or other suitable fastener. The tension pulley 160 supports movement of the first hose 150 and can retract the shower head 130 if the shower head 130 is extended outward by the user if desired by the user. The rivet 162 secures the tension pulley 160 so the first hose 150 from the pipe 180 moves freely. The two way connector 165 splits the first hose 150 into a first split hose 161 and a second split hose 163. The first split hose 161 provides water to the first hose 150. The two way connector 165 creates a vacuum 165' at the second end 154. The two way connector 165 is also a y-shaped connector 167. The two hose connector 170 is attached to the first split hose 161 of the first hose 150. The connector to a hand-held device 175 extends from the two hose connector 170 and sends water to a hand-held device 173. The pipe 180 extends from the vertical wall VW and is connected to the two hose connector 170 which connects the pipe 180 to the second end 154 of the first hose 150. The pipe 180 provides water to the first hose 150 which provides water to the shower head 130 used by the user. The electric pump dispenser 190 is battery operated with a battery and can dispense soap, shampoo or other suitable shower related liquids. The electric pump dispenser 190 can help reduce the likelihood of an individual slipping and falling due to dropping a soap bar while showering. The electric pump dispenser 190 is attached to the second split hose 163 and dispenses soap, shampoo or other suitable shower related liquids to the two way connector 165. The two way connector 165 controls the soap, shampoo or other suitable shower related liquids dispensed by the electric pump dispenser 190.

The extendable shower head apparatus is a multi-position shower head that introduces a flexible appliance that expands shower enjoyment. The extendable shower head apparatus is made of a hollow PVC pipe having a spring loaded coil that tracks along an outline of a rubber supported-end rod. The extendable shower head apparatus is able to stream along a shaft and possesses a standardized shower head in addition to a two-way hose connector for a secondary water head, with each being controlled by a tension pulley so that the extendable shower head apparatus can provide the height, position and water pressure that best fit the user's desire. The extendable shower head apparatus may be readily available at renowned household and bathroom remodeling retailers. The extendable shower head apparatus is intended to be marketed with a soap dispensing pump accessory designed to house three compartments and to help expedite access to body cleaning products. The function of a retractable shower head that provides an option of denoting the exact locale of an overhead may serve as a well-suited alternative in bathroom detailing of any household, institution, or any other place that can benefit from its convenience and accessibility features.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. An extendable shower head apparatus, comprising: a hollow support rod with a first end, a second end and a bottom portion, the first end and the second end being connected to opposing vertical walls, the hollow support rod provides support to the extendable shower head apparatus; a connection piece that is movably connected to the hollow support rod; a shower head that includes a hollow stem, the shower head is activated and shut-off by an on and off switch, the hollow stem is connected to the connection piece and the hollow stem allows water to flow to the shower head; a plurality of wheel bearings that roll along the hollow support rod, the wheel bearings facilitate the shower head moving along the hollow support rod; a first hose with a first end and a second end, the first hose is extended through the wheel bearings and provides the water to the shower head, the first end of the first hose being connected to the shower head; a support rod holder with a first end and a second end, the support rod holder supports the hollow support rod, the first end of the support rod holder is attached to the hollow support rod; a tension pulley that supports movement of the first hose, the second end of the support rod holder is attached to the tension pulley; a two way connector, connected to the second end of the first hose, the two way connector splits the first hose into a first split hose and a second split hose, the first split hose having a first end and a second end and the second split hose having a first end and a second end, the two way connector connected to the first end of the first split hose and the second split hose, the two way connector creates a vacuum at the second end of the first hose; a two hose connector attached to the second end of the first split hose; and a connector to a hand-held device that extends from the two hose connector, the connector to a hand-held device sends water to a hand-held device; a pipe that provides the water to the two hose connector used by a user, the pipe is connected to the two hose connector and the two hose connector fluidically connects the pipe to the second end of the first hose; a rivet to secure the tension pulley to the second end of the support rod holder so the first hose from the pipe moves freely; and an electric pump dispenser that dispenses a selected one of soap, shampoo and a shower related liquid, the electric pump dispenser is attached to the second end of the second split hose and dispenses the selected one of soap, shampoo and shower related liquids to the two way connector, the two way connector controls the selected one of soap, shampoo and shower related liquids dispensed by the electric pump dispenser.

2. The extendable shower head apparatus according to claim 1, wherein the first end and the second end of the hollow support rod each have a spring-loaded rubber end.

3. The extendable shower head apparatus according to claim 2, wherein the spring-loaded rubber ends each apply pressure to one of the opposing vertical walls to hold-up the extendable shower head apparatus.

4. The extendable shower head apparatus according to claim 1, wherein the hollow support rod includes a horizontal groove disposed along the bottom portion of the hollow support rod, the horizontal groove enables the shower head and the connection piece to move along the hollow support rod.

5. The extendable shower head apparatus according to claim 1, wherein the hollow stem and the shower head move along the hollow support rod.

6. The extendable shower head apparatus according to claim 1, wherein the shower head allows the user to move along the hollow support rod providing the user with a greater freedom of movement than a traditional shower head.

7. The extendable shower head apparatus according to claim 1, wherein the first end of the first hose is attached to the shower head stem.

8. The extendable shower head apparatus according to claim 1, wherein the tension pulley retracts the shower head when the shower head is extended outward by the user.

9. An extendable shower head apparatus, comprising: a hollow support rod with a first end, a second end and a bottom portion, the hollow support rod provides support to the extendable shower head apparatus, the first end and the second end of the hollow support rod each have a spring-loaded rubber end and the spring-loaded rubber ends each apply pressure on a vertical wall to hold-up the extendable shower head apparatus; a connection piece that is movably connected to the hollow support rod; a shower head that includes a hollow stem, the shower head is activated and shut-off by an on and off switch, the hollow stem is connected to the connection piece and the hollow stem allows water to flow to the shower head; a plurality of wheel bearings that roll along the hollow support rod, the wheel bearings facilitate the shower head moving along the hollow support rod; a first hose with a first end and a second end, the first hose is extended through the wheel bearings and provides the water to the shower head, the first end of the first hose being connected to the shower head; a support rod holder with a first end and a second end, the support rod holder supports the hollow support rod, the first end of the support rod holder is attached to the hollow support rod; a tension pulley that supports movement of the first hose, the second end of the support rod holder is attached to the tension pulley; a two way connector, connected to the second end of the first hose, the two way connector splits the first hose into a first split hose and a second split hose, the first split hose having a first end and a second end and the second split hose having a first end and a second end, the two way connector connected to the first end of the first split hose and the second split hose, the two way connector creates a vacuum at the second end of the first hose; a two hose connector attached to the second end of the first split hose; a pipe that provides the water to the two hose connector used by a user, the pipe is connected to the two hose connector and the two hose connector fluidically connects the pipe to the second end of the first hose; a rivet to secure the tension pulley to the second end of the support rod holder so the first hose from the pipe moves freely; and an electric pump dispenser that dispenses a selected one of soap, shampoo and a shower related liquid, the electric pump dispenser is attached to the second end of the second split hose and dispenses the selected one of soap, shampoo and shower related liquids to the two way connector, the two way connector controls the selected one of soap, shampoo and shower related liquids dispensed by the electric pump dispenser.

10. The extendable shower head apparatus according to claim 9, wherein the hollow stem and the shower head move along the hollow support rod.

11. The extendable shower head apparatus according to claim 9, wherein the hollow support rod includes a horizontal groove disposed along the bottom portion of the hollow support rod, the horizontal groove enables the shower head and the connection piece to move along the hollow support rod.

12. The extendable shower head apparatus according to claim 9, wherein the shower head allows the user to move along the hollow support rod providing the user with a greater freedom of movement than a traditional shower head.

13. The extendable shower head apparatus according to claim 9, wherein the first end of the first hose is attached to the shower head stem.

14. The extendable shower head apparatus according to claim 9, wherein the tension pulley retracts the shower head when the shower head is extended outward by the user.

15. The extendable shower head apparatus according to claim 9, wherein the pipe extends from the vertical wall.

16. An extendable shower head apparatus, comprising: a hollow support rod with a first end, a second end and a bottom portion, the hollow support rod provides support to the extendable shower head apparatus, the first end and the second end of the hollow support rod each have a spring-loaded rubber end, the spring-loaded rubber ends each apply pressure on a vertical wall to hold-up the extendable shower head apparatus and the hollow support rod includes a horizontal groove disposed along the bottom portion of the hollow support rod, the horizontal groove enables the shower head to move along the hollow support rod; a connection piece that is movably connected to the hollow support rod; a shower head that includes a hollow stem, the shower head is activated and shut-off by an on and off switch, the hollow stem is connected to the connection piece, the hollow stem allows water to flow to the shower head, and the hollow stem and the shower head and the connection piece move along the hollow support rod, and the shower head allows a user to move along the hollow support rod providing the user with a greater freedom of movement; a plurality of wheel bearings that roll along the hollow support rod, the wheel bearings facilitate the shower head moving along the hollow support rod; a first hose with a first end and a second end, the first hose is extended through the wheel bearings and provides the water to the shower head, the first end of the first hose being connected to the shower head; a support rod holder with a first end and a second end, the support rod holder supports the hollow support rod, the first end of the support rod holder is attached to the hollow support rod; a tension pulley that supports movement of the first hose, the second end of the support rod holder is attached to the tension pulley; a two way connector, connected to the second end of the first hose, the two way connector splits the first hose into a first split hose and a second split hose, the first split hose having a first end and a second end and the second split hose having a first end and a second end, the two way connector connected to the first end of the first split hose and the second split hose, the two way connector creates a vacuum at the second end of the first hose; a two hose connector attached to the second end of the first split hose; a pipe that provides the water to the two hose connector used by the user, the pipe is connected to the two hose connector and the two hose connector fluidically connects the pipe to the second end of the first hose; a rivet to secure the tension pulley to the second end of the support rod holder so the first hose from the pipe moves freely; and an electric pump dispenser that dispenses a selected one of soap, shampoo and a shower related liquid, the electric pump dispenser is attached to the second end of the second split hose and dispenses the selected one of soap, shampoo and shower related liquids to the two way connector, the two way connector controls the selected one of soap, shampoo and shower related liquids dispensed by the electric pump dispenser.

17. The extendable shower head apparatus according to claim 16, wherein the first end of the first hose is attached to the shower head stem.

18. The extendable shower head apparatus according to claim 16, wherein the tension pulley retracts the shower head when the shower head is extended outward by the user.

19. The extendable shower head apparatus according to claim 16, wherein the pipe extends from the vertical wall.

20. The extendable shower head apparatus according to claim 16, wherein the hollow support rod is made of polyvinyl chloride.

* * * * *